US007731553B2

(12) United States Patent
Rui

(10) Patent No.: US 7,731,553 B2
(45) Date of Patent: Jun. 8, 2010

(54) WATERCRAFT PROPELLED BY A WATER JET

(75) Inventor: Yuting Rui, Ann Arbor, MI (US)

(73) Assignee: Surfango, Inc., Lakewood, NJ (US)

( * ) Notice: Subject to any disclaimer, the term of this patent is extended or adjusted under 35 U.S.C. 154(b) by 60 days.

(21) Appl. No.: 11/869,000

(22) Filed: Oct. 9, 2007

(65) Prior Publication Data

US 2009/0093174 A1 Apr. 9, 2009

(51) Int. Cl.
*B63B 35/73* (2006.01)

(52) U.S. Cl. ..... 440/88 A; 114/55.51

(58) Field of Classification Search ..... 440/88 A; 114/55.51, 55.53, 55.5
See application file for complete search history.

(56) References Cited

U.S. PATENT DOCUMENTS

| | | | |
|---|---|---|---|
| 2,434,700 | A | 1/1948 | Keckley |
| 3,043,260 | A | 7/1962 | Tank |
| 3,262,413 | A | 7/1966 | Douglas et al. |
| 3,292,373 | A | 12/1966 | Tado |
| 3,324,822 | A | 6/1967 | Carter, III |
| 3,369,518 | A | 2/1968 | Jacobson |
| 3,408,976 | A | 11/1968 | Ellis |
| 3,426,724 | A | 2/1969 | Jacobson |
| 3,463,116 | A | 8/1969 | Dawson |
| 3,481,303 | A | 12/1969 | Tate et al. |
| 3,548,778 | A | 12/1970 | Von-Smagala-Romanon |
| 3,608,512 | A | 9/1971 | Thompson |
| 3,882,815 | A | 5/1975 | Bennett |
| 4,020,782 | A | 5/1977 | Gleason |
| 4,047,494 | A | 9/1977 | Scott |
| 4,229,850 | A | 10/1980 | Arcouette |
| 4,237,812 | A | 12/1980 | Richardson |
| 4,274,357 | A | 6/1981 | Dawson |
| 4,321,048 | A | 3/1982 | Marchese et al. |
| 4,457,724 | A | 7/1984 | Miyamoto |
| D276,994 | S | 1/1985 | Montgomery et al. |
| 4,497,631 | A | 2/1985 | Belanger |
| 4,538,996 | A | 9/1985 | Inwood |
| 4,589,365 | A | 5/1986 | Masters |
| 4,765,075 | A | 8/1988 | Nakase et al. |

(Continued)

FOREIGN PATENT DOCUMENTS

| | | |
|---|---|---|
| FR | 2617793 | 2/1989 |

(Continued)

OTHER PUBLICATIONS

English language machine translation of FR 2617793 obtained from European Patent Office website (www.espacenet.com).

(Continued)

*Primary Examiner*—Stephen Avila
(74) *Attorney, Agent, or Firm*—Dykema Gossett PLLC

(57) ABSTRACT

A watercraft propelled by a water jet includes an sealed hull portion including an upper deck and a bottom surface, an engine compartment located behind the sealed hull portion and containing a propulsion and steering system including an engine, a bladed impeller driven by the engine for inducting water and forcing the inducted water away from the craft through a directionally displaceable nozzle, and a control lever located on the upper deck including an engine throttle control and a steering control for adjusting the directionally displacement of the nozzle.

16 Claims, 3 Drawing Sheets

U.S. PATENT DOCUMENTS

| | | | | |
|---|---|---|---|---|
| 4,781,141 | A | 11/1988 | Webb et al. | |
| 4,942,838 | A | 7/1990 | Boyer et al. | |
| 4,997,399 | A * | 3/1991 | Nakayasu et al. | 440/89 F |
| 5,017,166 | A | 5/1991 | Chang | |
| 5,096,446 | A | 3/1992 | Tazaki et al. | |
| 5,209,683 | A | 5/1993 | Imaeda et al. | |
| 5,254,024 | A | 10/1993 | Kobayashi et al. | |
| 5,449,305 | A * | 9/1995 | Kobayashi et al. | 440/38 |
| 5,481,997 | A | 1/1996 | Arndt | |
| 5,558,549 | A * | 9/1996 | Nakase et al. | 440/88 L |
| 5,582,529 | A | 12/1996 | Montgomery | |
| 5,628,269 | A | 5/1997 | Henmi et al. | |
| 6,413,130 | B2 * | 7/2002 | Hattori | 440/88 R |
| 6,435,119 | B1 * | 8/2002 | Pelletier et al. | 114/55.51 |
| 2001/0042498 | A1 * | 11/2001 | Burnham | 114/55.56 |
| 2004/0154513 | A1 * | 8/2004 | Matsuda | 114/55.53 |

FOREIGN PATENT DOCUMENTS

| | | |
|---|---|---|
| JP | 1148694 | 6/1989 |
| JP | 3295791 | 1/1991 |

OTHER PUBLICATIONS

English language abstract for JP 1148694 obtained from European Patent Office website (www.espacenet.com).
English language abstract for JP 3295791 obtained from European Patent Office website (www.espacenet.com).

* cited by examiner

WATERCRAFT PROPELLED BY A WATER JET

BACKGROUND OF THE INVENTION

1. Field of the Invention

This invention relates generally to a boat propelled by a water jet. In particular, the invention pertains to a kayak-like watercraft powered by an engine, and having a hull on which the rider sits and controls speed and direction.

2. Description of the Prior Art

Traditional kayaks typically accommodate one, two or occasionally three riders who sit facing forward in one or more cockpits below the deck of the boat and propel the craft by paddling. A waterproof cover attaches securely to the edges of the cockpit, preventing entry of water, and making it possible for the boat to roll upright again without the boat filling with water after tipping over.

Increasingly, manufacturers are building leisure "sit-on-top" variants of the traditional kayak with a fixed rudder for directional stability. Water that enters the cockpit drains out through holes or tubes that run from the cockpit to the bottom of the hull. Sit-on-top kayaks usually come in single and double paddler designs and are particularly popular for fishing and SCUBA diving, since such riders must easily enter and exit the water, change seating positions, and access hatches and storage wells. Ordinarily the seat of a sit-on-top is slightly above water level, so that the center of gravity of the paddler is higher than in a traditional kayak. To compensate for the center of gravity, a sit-on-top is often wider than a traditional kayak of the same length, and is slower.

Attempts have been made to provide a power source to propel kayaks, but the inherent instability of the hull and the susceptibility of the engine to damage in the event of a tip over is a serious consideration.

A need exists for a powered "sit-on-top kayak that provides simple, convenient, intuitive control of the engine and steering. The hull and engine compartment should be sealed against entry of water when the craft is upright or tipped over, yet provide for air to enter the engine through the engine compartment. The craft should have high strength, low weight, little vibration and provide excellent floatation.

SUMMARY OF THE INVENTION

A watercraft propelled by a water jet includes a sealed hull portion including a bottom surface and an upper deck defining a space containing material for reinforcing the upper deck and bottom surface against damage, the upper deck being formed with a seat and including a seat back for supporting a rider located in the seat. An engine compartment, located behind the seat, contains an engine, a bladed impeller located behind the engine and driven by the engine, for inducting water and forcing the inducted water away from the rear of the watercraft through a nozzle. The nozzle is supported to pivot about a first axis. A control lever located on the upper deck is supported to pivot about a second axis and is operatively connected to the nozzle, for pivoting the nozzle about the first axis in response to pivoting the control lever about the second axis.

The rider sits on the upper deck with legs extended along the deck and straddling the control lever. An accelerator for adjusting engine speed and starting and stopping the engine are located on the control lever. The craft is steered and maneuvered by pivoting the control lever rightward and leftward, thereby causing the nozzle to pivot and direct the water jet in a direction that causes the watercraft to turn in the direction that the lever is pivoted.

The hull is divided by a partitioning wall or bulkhead between the rider sitting area and the engine compartment. The engine compartment occupies a small space.

An air intake and cowling allow the craft to roll over upside-down without inducting water into the engine compartment. This feature enables the engine to be readily restarted following a rollover event.

Space between the upper deck and bottom surface contains a core material that strengthens and reinforces the deck and bottom surface against damage due to impact with a foreign object, thereby avoiding dents and other surface defects that would impair high performance operation. The hull and engine compartment are fully sealed to enhance floatation, achieving high strength with low weight, little vibration and excellent floatation characteristics.

The control lever pivots downward to facilitate storage of the craft in a compact space.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
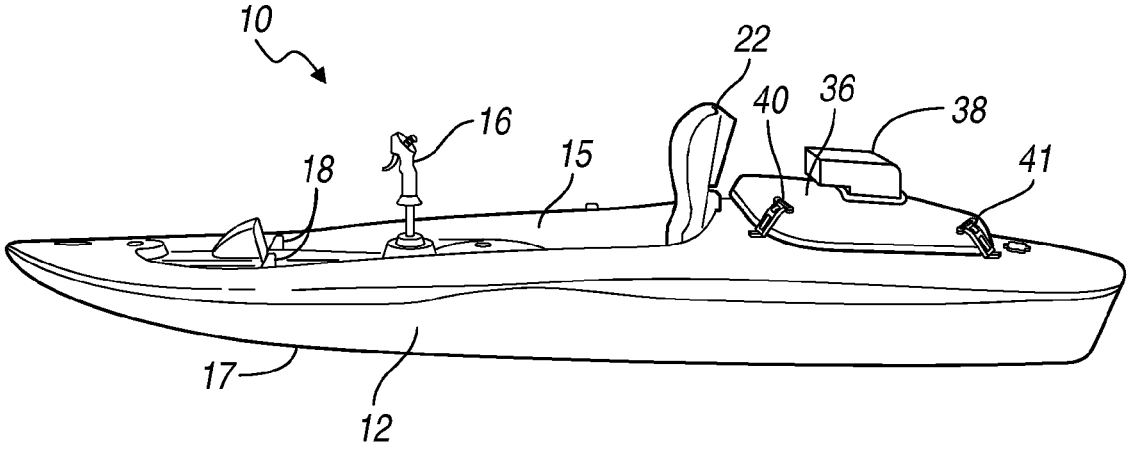
FIG. 1 is a side view of a kayak propelled by a water jet.
Figure 2:
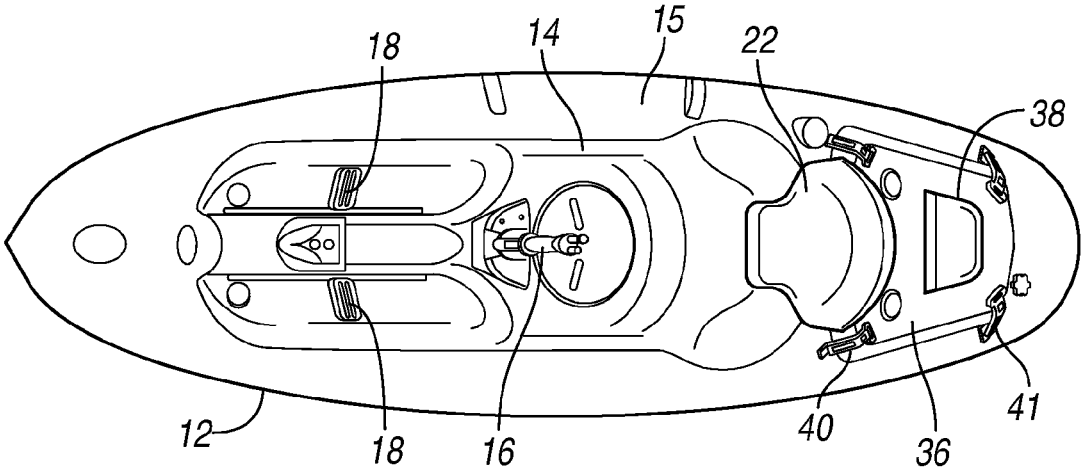
FIG. 2 is a top view of the kayak shown in FIG. 1.
Figure 3:
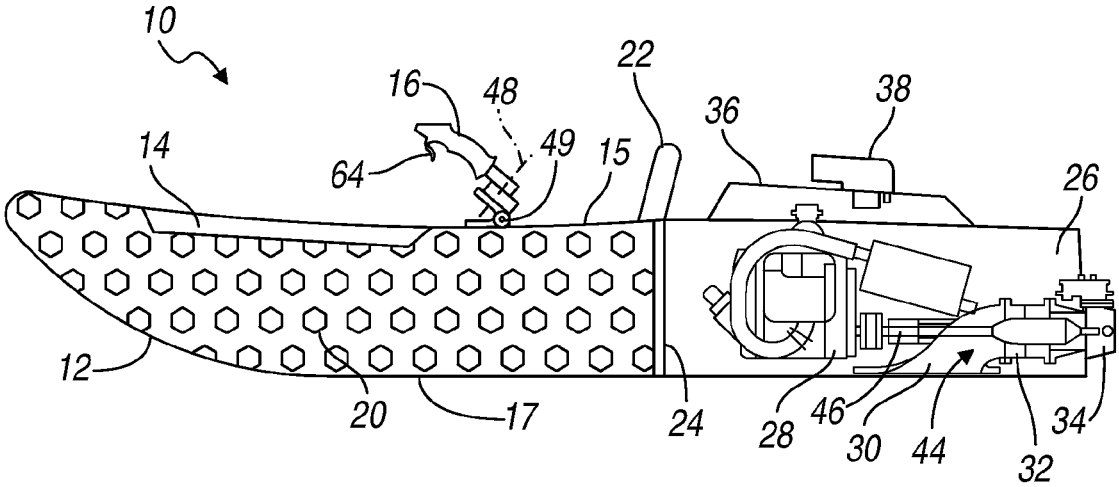
FIG. 3 is a cross sectional side view of the kayak shown in FIG. 1.
Figure 4:
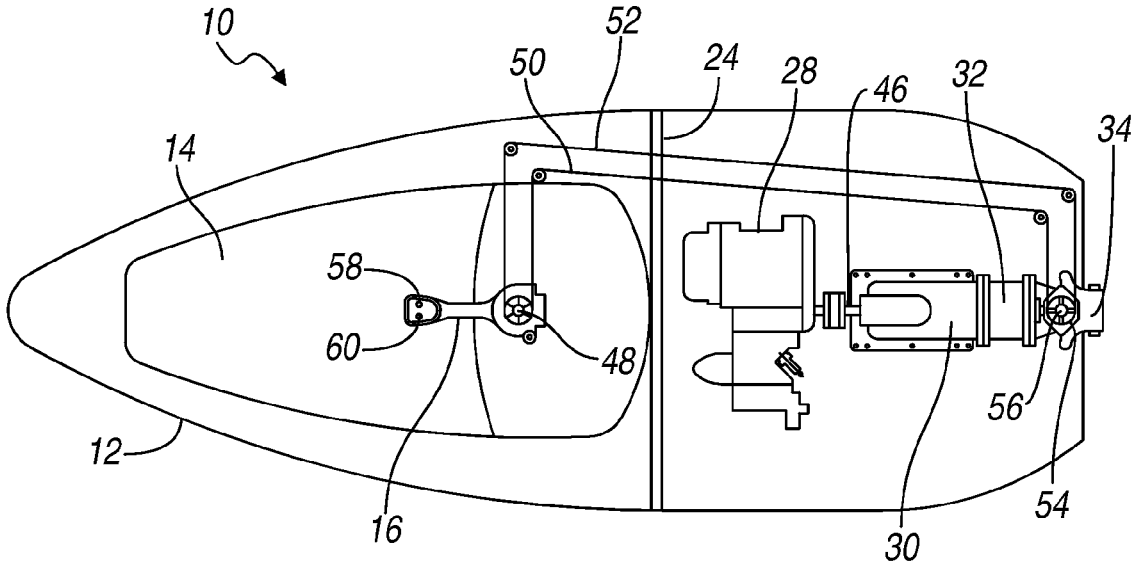
FIG. 4 is a top view of the kayak shown in FIG. 3.

Referring now to FIGS. 1-4, a kayak 10 includes a sealed hull portion 12 covered with a seamless molded plastic skin, which preferably is a composite material that includes a plastic matrix reinforced with stands of fiberglass, carbon or Kevlar. The skin may be formed of HDPE laminated polymer plastic.

The hull is formed with a recess 14 on its upper surface 15, in which recess the rider sits facing forward with legs straddling a manually-operated control lever 16 (called a joystick) and feet supported on foot rests 18. The volume of hull 12 between its upper deck 15 and its bottom surface 17 is filled with a core material 20 that reinforces, strengthens and stiffens the hull. The material of the core 20 may be machined or preferably expanded polystyrene foam, or expanded polyurethane foam. Alternatively, the core material may be a hollow, hexangular honeycomb of Kevlar or a similar synthetic material. The hull portion 12 is sealed, thereby preventing entry of water from waves or spray and making it possible to roll the kayak upright again without it filling with water following a tip over.

A seat back 22, secured to the upper surface of the hull 12 supports the seated rider. The core reinforced portion of the hull 12 is closed by a partition or bulkhead 24, located at the forward end of an engine compartment 26, which contains an engine 28, water intake duct 30, bladed impeller 32 that forces water from the intake duct, and a nozzle 34, whose angular position about a vertical axis can be varied leftward and rightward to steer the kayak 10. Water inducted through duct 30 flows through the impeller and exits through the nozzle 34.

The engine compartment 26 is covered with a cowling 36 formed with an air inlet passageway 38. Cowling 36 is secured by latches 40, 41 to the upper surface 15 of the hull, thereby sealing the engine compartment 26 against entry of water when the cowling is latched to the hull.

The intake duct 30, which may be a component separate from the hull 12 or formed integrally with the hull, is of molded plastic having an intake opening 44 in the bottom of the hull, through which water is inducted and flows toward the outlet of nozzle 34. A driveshaft 46, secured to the crankshaft of engine 28 drives the bladed impeller 32. A water jet, which propels and steers the kayak 10, rises from the outlet of nozzle 34 into the air above the water surface.

The rider pivots the joystick 16 leftward and rightward about an axis 48 to steer the craft. The rider also pivots the joystick 16 upward and downward about axis 49 to locate its hand grip in a comfortable position during use and in a downward position when the craft 10 is stored or being transported. As the joystick 16 pivots, cables 50, 52, supported on pulleys, transmit movement of the joystick to a steering controller 54, which pivots about an axis 56 in response to pivoting of the joystick 16 about axis 48.

Nozzle 34 also pivots about axis 56 as the joystick pivots, thereby steering and maneuvering the kayak leftward and rightward by redirecting the water jet exiting the nozzle relative to the longitudinal axis of the craft.

The joystick 16 carries a button 58, which is depressed to start engine 28; a button 60 that stops the engine; or a single button having an engine starting state and a stopping state; a kill switch and, an engine throttle in the form of a trigger 64 located on the underside of the joystick, by which the engine throttle is opened and closed to control engine speed and speed of the kayak 10.

Figure 5:
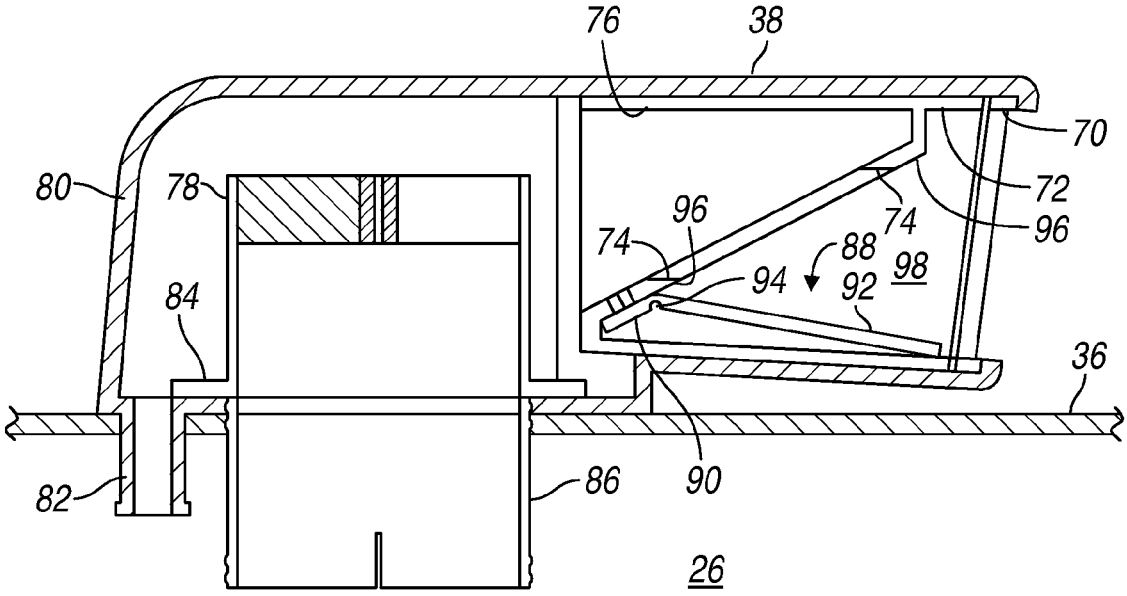
FIG. 5 is a cross section of the air inlet taken at plane 5-5 of FIG. 2 and showing the air duct open.

FIG. 5 shows the air inlet 38 supported on the cowling 36 above the engine compartment 26. The inlet 38 is of molded plastic having a forward facing opening 70, a frame 72 having an inclined opening 74, and a duct 76 that carries air rearward toward two laterally aligned circular cylindrical air ducts 78. The end of duct 76 is closed by a wall 80 having at its base a drain 82, through which water and air may be carried from the inlet 38 to the engine compartment 26.

Each air duct 78 is supported by a flange 84 seated on the upper surface of cowling 38. The outer surface 86 of each duct 78 may be formed with an external screw thread, which is engaged by a jam nut contacts the lower surface of cowling 36, thereby securing the duct to the cowling. Alternatively, the mounting flange 84 of each duct 78 is bonded to the upper surface of cowling 36 to secure the duct to the cowling.

A flexible rubber flapper seal valve 88 includes a leg 90 that is secured to the lower outer surface of frame 72, and a panel 92 that extends laterally across the width and longitudinally across the height of opening 74 when the flapper seal 88 is closed. Panel 92 is made of material that is lighter than water. Preferably its specific weight is in the range from 0.6 to 0.9. A circular recess 94, formed at the base of panel 92, facilitates flexural movement of the panel from its normally-open position, which is shown in FIG. 5, to its closed position, at which the panel overlaps and becomes seated on the flat surface 96 along the perimeter of opening 74, thereby closing the opening, shown in FIG. 6.

In operation, if the kayak 10 were to overturn in the water, flapper seal valve 88 would immediately close the opening 74 due to the weight of panel 92 pivoting at recess 94. Water then fills the space 98 that is external to opening 74 and panel 92, forcing the panel into contact with surface 96, thereby positively sealing opening 74 against water leakage into duct 76. The seal 88 prevents water from entering the engine compartment through the air ducts 78. When water leaves space 98 and the kayak is turned upright, flapper seal 88 immediately opens, permitting air to be drawn into the engine compartment and into the engine 28.

Figure 6:
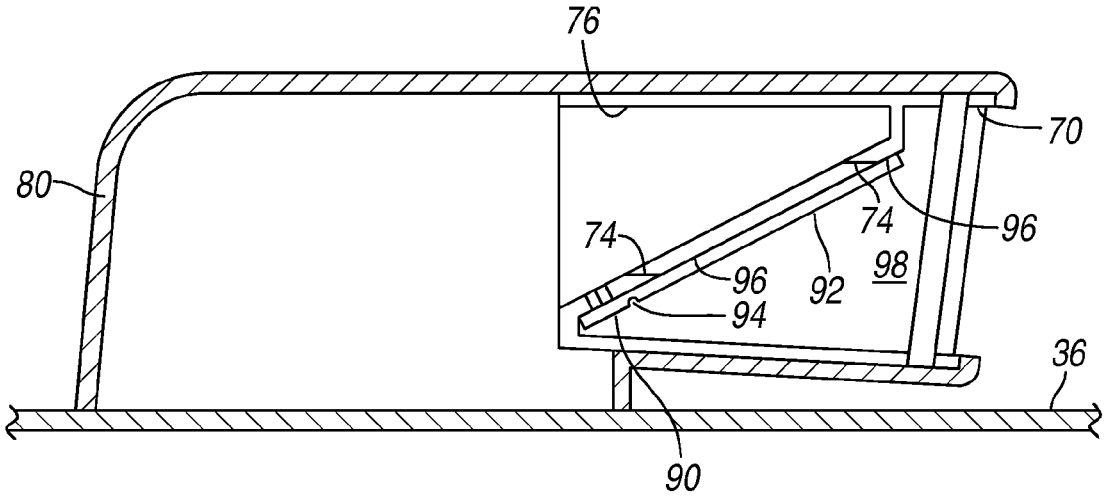
FIG. 6 is a cross section of the air inlet showing the air duct closed by a sealing valve.

If the kayak 10 were submerged under water in the upright position shown in FIG. 5, panel 92 would float upward to the position shown in FIG. 6 due to its specific weight being lower than that of water. Water then flows into space 98 toward the opening 74, forcing the panel into contact with surface 96, thereby positively sealing opening 74 against water leakage into duct 76. The seal 88 prevents water from entering the engine compartment through air ducts 78. When water leaves space 98, flapper seal 88 immediately opens, permitting air to be drawn into the engine compartment and into the engine 28.

In accordance with the provisions of the patent statutes, the preferred embodiment has been described. However, it should be noted that the alternate embodiments can be practiced otherwise than as specifically illustrated and described.

What is claimed is:

1. A watercraft propelled by a water jet comprising:

a hull including an upper deck and a bottom surface defining a space therebetween, the hull including a sealed hull portion;

an engine compartment located adjacent the sealed hull portion and containing a propulsion and steering system including an engine, a bladed impeller driven by the engine for inducting water and forcing the inducted water away from the craft through a directionally displaceable nozzle;

a control lever located on the upper deck including a steering control for adjusting the directional displacement of the nozzle;

a cowling for covering and sealing an opening formed in the upper deck, the opening providing access to the engine compartment, the cowling including an air inlet defining a duct in which air is carried to the engine compartment and including a frame defining an opening to the duct and a valve seat about the opening, and a valve that moves away from the valve seat to a first position, at which the duct is open, and into engagement with the vale seat at a second position, at which the duct is closed wherein gravity urges the valve to the first position when the watercraft is upright and to the second position when the craft is inverted and wherein the valve is made from a material lighter than water such that the valve is urged to the second position against the force of gravity when the craft is upright and submerged in water.

2. The watercraft of claim 1 wherein the upper deck further comprises a surface for supporting a forward-facing rider seated thereon, space for legs of the seated rider to straddle the control lever, and a seat back for supporting the rider in a seated position on the upper deck surface.

3. The watercraft of claim 1 wherein the engine compartment further comprises:

a water intake opening formed in the bottom surface of the hull; and an intake duct communicating with the intake opening for directing water from the intake opening to the impeller.

4. The watercraft of claim 3 wherein:

the engine is located forward of the intake opening; and an outlet of the nozzle is located at the rear of the watercraft.

5. The watercraft of claim 1 wherein the control lever further includes an engine ignition control for starting and stopping the engine.

6. The watercraft of claim 1 wherein the upper deck is formed with a seat and includes a seat back for supporting a rider located in the seat.

7. The watercraft of claim 6 wherein the upper deck is formed with a recess that encircles the rider when located in the seat.

8. The watercraft of claim 6 wherein the upper deck further comprises a recessed surface for supporting the rider when facing forward and seated thereon, the surface including space for legs of the seated rider to straddle the control lever.

9. The watercraft of claim 1 wherein the sealed hull portion contains a core material for reinforcing the upper deck and bottom surface.

10. The watercraft of claim 9 wherein the core material comprises an expanded foam.

11. The watercraft of claim 1 wherein the control level includes an engine throttle control.

12. The watercraft of claim 1, further comprising a bulkhead disposed between the sealed hull portion and the engine compartment.

13. The watercraft of claim 1 wherein the nozzle is supported to pivot about a first axis and the control level is supported to pivot about a second axis, the control lever operatively connected to the nozzle for pivoting the nozzle about the first axis in response to pivoting the control lever about the second axis.

14. The watercraft of claim 1 wherein the watercraft comprises a kayak.

15. The watercraft of claim 1 wherein one end of the control lever is supported to pivot about an axis permitting an opposite end of the control lever to move towards and away from the upper deck.

16. The watercraft of claim 1 wherein the valve includes a leg attached to the frame and a panel extending from the leg, the panel capable of pivotal movement relative to the leg.

* * * * *